US011545789B2

(12) United States Patent
Unterhauser et al.

(10) Patent No.: US 11,545,789 B2
(45) Date of Patent: Jan. 3, 2023

(54) ELECTRICAL PLUG-IN CONNECTOR AND METHOD FOR PRODUCING AN ELECTRICAL PLUG-IN CONNECTOR

(71) Applicant: Rosenberger Hochfrequenztechnik GmbH & Co. KG, Fridolfing (DE)

(72) Inventors: Thomas Unterhauser, Obing (DE); Georg Christoph Michael Lochner, Tittmoning (DE); Martin Arthur Kositza, Romrod (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 17/176,556

(22) Filed: Feb. 16, 2021

(65) Prior Publication Data

US 2021/0273380 A1 Sep. 2, 2021

(30) Foreign Application Priority Data

Feb. 28, 2020 (EP) ..... 20160092

(51) Int. Cl.
*H01R 13/6477* (2011.01)
*H01B 11/00* (2006.01)
(Continued)

(52) U.S. Cl.
CPC ..... *H01R 13/6477* (2013.01); *H01B 11/002* (2013.01); *H01R 13/518* (2013.01); *H01R 13/6581* (2013.01)

(58) Field of Classification Search
CPC ..... H01R 13/6477; H01R 13/6581; H01R 13/518; H01B 11/002
(Continued)

(56) References Cited

U.S. PATENT DOCUMENTS 9,306,312 B2 * 4/2016 Dang ..... H01R 13/582
9,787,031 B2 * 10/2017 Ludwig ..... H01R 43/04
(Continued)

FOREIGN PATENT DOCUMENTS

WO WO-2018082827 A1 * 5/2018 ..... H01R 13/518
WO WO-2019154788 A1 * 8/2019 ..... H01R 13/6592

OTHER PUBLICATIONS

European Search Report dated August 6, 2020.

*Primary Examiner* — Peter G Leigh
(74) *Attorney, Agent, or Firm* — Randall Danskin P.S.

(57) ABSTRACT

An electrical plug-in connector for differential signal transmission, having an external conductor contact element, a dielectric and at least one internal conductor contact element pair for differential signal transmission. The dielectric extends along a longitudinal axis through the external conductor contact element. The internal conductor contact element pair has a first internal conductor contact element and a second internal conductor contact element which extend along the longitudinal axis through the dielectric. The external conductor contact element and/or the dielectric have a compensation geometry in order to compensate for an asymmetry of the internal conductor contact element pair with respect to the longitudinal axis. As an alternative or in addition, it is provided that the internal conductor contact element pair has a compensation geometry in order to compensate for an asymmetry of the external conductor contact element and/or of the dielectric with respect to the longitudinal axis.

20 Claims, 10 Drawing Sheets

(51) Int. Cl.
*H01R 13/518* (2006.01)
*H01R 13/6581* (2011.01)

(58) Field of Classification Search
USPC ..... 439/607.01
See application file for complete search history.

(56) References Cited

U.S. PATENT DOCUMENTS

| | | | | |
|---|---|---|---|---|
| 9,905,978 | B2 * | 2/2018 | Zebhauser | H01R 4/183 |
| 10,367,311 | B2 * | 7/2019 | Zebhauser | H01R 4/20 |
| 10,389,062 | B2 * | 8/2019 | Zebhauser | H01R 13/6463 |
| 2015/0162113 | A1 | 6/2015 | Ishikawa | |
| 2015/0349472 | A1 * | 12/2015 | Zebhauser | H01R 13/506 439/660 |
| 2018/0013241 | A1 * | 1/2018 | Zebhauser | H01R 4/20 |
| 2018/0026402 | A1 * | 1/2018 | Zebhauser | H01R 13/6581 439/607.5 |
| 2019/0058268 | A1 * | 2/2019 | Müller | H01R 13/6474 |
| 2019/0199028 | A1 * | 6/2019 | Maesoba | H01R 13/405 |
| 2019/0267727 | A1 * | 8/2019 | Zebhauser | H01R 13/6474 |
| 2019/0393651 | A1 * | 12/2019 | Lödding | H01R 13/6471 |

* cited by examiner

ELECTRICAL PLUG-IN CONNECTOR AND METHOD FOR PRODUCING AN ELECTRICAL PLUG-IN CONNECTOR

RELATED APPLICATIONS

This US National Phase Utility Patent Application claims priority to European Patent Application No. 20 160 092.1 which was filed on 28 Feb. 2020. The entire contents of the aforementioned European Patent Application is expressly and fully incorporated herein by this reference. This claim of priority is also being made in, and is set forth in, the Application Data Sheet (ADS) filed contemporaneously herewith.

BACKGROUND

The present invention relates to an electrical plug-in connector for differential signal transmission, having an external conductor contact element, a dielectric and at least one internal conductor contact element pair for differential signal transmission.

The invention further relates to a method for producing an electrical plug-in connector for differential signal transmission, wherein the electrical plug-in connector has an external conductor contact element, a dielectric and at least one internal conductor contact element pair for differential signal transmission.

As is known, electrical plug-in connectors serve to transmit electrical supply signals and/or data signals to corresponding mating plug-in connectors. A plug-in connector, or mating plug-in connector, may be a plug, a panel plug, a socket, a coupling, a printed circuit board plug-in connector or an adapter. The terms "plug-in connector" and, respectively, "mating plug-in connector" used within the scope of the invention are representative of all variants.

Particularly in plug-in connectors for radiofrequency technology, for example for data transmission in vehicles, considerable demands are placed on the electrical properties of the plug-in connections. Sometimes during autonomous operation of a vehicle or when using assistance systems, large amounts of data from a plurality of cameras, various sensors and navigation sources have to be combined with one another and transported, usually in real time. The operation of a large number of devices, screens and cameras accordingly requires an efficient infrastructure in the vehicle electronics system. The demands placed on the plug-in connectors and the cable connections within a vehicle with respect to the necessary data rates are now very high for this reason. At the same time, it is important to design the plug-in connectors to be as compact as possible in order to save installation space and weight.

In order to transmit electrical signals with a high data rate, for example with a data rate of 1.0 Gbit/s or more, differential signal transmission (also known as "symmetrical signal transmission") is preferable to asymmetrical signal transmission (also known as "non-symmetrical signal transmission" or "single-ended signal transmission").

In order to ensure symmetrical operation which is as pure as possible, internal conductor contact elements with a symmetrical cross-sectional profile are arranged within an external conductor contact element with a likewise symmetrical cross-sectional profile in practice. The symmetry of the plug-in connector is necessary since the electromagnetic wave is transmitted in amplified form in the so-called "common mode" with increasing asymmetry and ultimately common mode interference signals can have a negative effect on the signal transmission. In the case of purely symmetrical or differential operation, the highest field line density of the electromagnetic field is found between the two internal conductor contact elements which form a common differential internal conductor contact element pair. The signal energy of the radiofrequency electromagnetic wave is therefore concentrated in the region between the two internal conductor contact elements. In the best-case scenario, no signal energy is lost to the outside as a result. However, in the "common mode", the electromagnetic field lines of the electromagnetic wave run parabolically from the connecting line between the two internal conductor contact elements to the outside. In particular, in the case of non-optimal electromagnetic shielding, electromagnetic field lines can run as far as the surrounding housing components, for example a motor vehicle body, in this way. As a result, signal energy can be lost, thus affecting or impairing the electromagnetic compatibility (EMC) of the entire system and the signal-to-noise ratio (SNR).

On account of the high demands placed on plug-in connectors for transmitting differential signals in radiofrequency technology, the expenditure on producing said plug-in connectors is comparatively high. This is a state which is still in need of improvement, in particular in respect of economical mass production of the plug-in connectors.

In view of the known prior art, the object of the present invention is that of providing an electrical plug-in connector which can advantageously be suitable for differential signal transmission, in particular in radiofrequency technology, and which can preferably be produced in a cost-effective manner.

The present invention is also based on the object of providing an improved method for producing an electrical plug-in connector for differential signal transmission, in particular for differential signal transmission in radiofrequency technology.

An electrical plug-in connector for differential signal transmission is provided. The electrical plug-in connector has at least one external conductor contact element, at least one dielectric and at least one internal conductor contact element pair for differential signal transmission. The dielectric extends along a longitudinal axis through the external conductor contact element. The internal conductor contact element pair comprises a first internal conductor contact element and a second internal conductor contact element which extend along the longitudinal axis through the dielectric.

The longitudinal axis is preferably a center axis, or axis of symmetry.

Within the scope of the invention, an internal conductor contact element can be designed, for example, as a pin contact or as a socket contact. Any desired internal conductor contact elements, for example including end contacts such as flat contracts or spring contact pins (so-called pogo pins), can be provided in principle.

The electrical plug-in connector can also have yet further plug-in connector components, for example an outer housing assembly, for example an outer housing assembly composed of plastic, in order to receive an external conductor contact element or a plurality of external conductor contact elements.

According to a first variant of the invention, it is provided that the external conductor contact element and/or the dielectric, have a compensation geometry in order to compensate for an asymmetry (for example an asymmetrical arrangement and/or an asymmetrical cross-sectional profile) of the internal conductor contact element pair with respect to the longitudinal axis.

A plurality of compensation geometries can also be provided within the scope of the invention. However, for reasons of clarity, the invention is described substantially with reference to a single compensation geometry below.

However, in addition to compensation of an asymmetry of the internal conductor contact element pair, an asymmetry of the external conductor contact element and/or of the dielectric can also be compensated for by a compensation geometry of the internal conductor contact element pair and/or of the dielectric.

Therefore, according to a second, optional or alternative variant of the invention, it is provided that the internal conductor contact element pair has a compensation geometry in order to compensate for an asymmetry (for example an asymmetrical arrangement and/or an asymmetrical cross-sectional profile) of the external conductor contact element and/or of the dielectric with respect to the longitudinal axis.

An asymmetrical cross-sectional profile of the external conductor contact element can be provided, for example, by recesses (for example windows), spring elements (for example spring tabs) or latching elements (for example latching lugs).

In general, an "asymmetry" within the scope of the invention may be understood to mean an asymmetrical geometry, or an asymmetrical cross-sectional profile of at least one internal conductor contact element, of the external conductor contact element and/or of the dielectric. However, an "asymmetry" may also be understood to mean a non-uniform distribution or arrangement, for example a non-uniform distribution or arrangement of at least one internal conductor contact element within the external conductor contact element. A rotation, for example a relative rotation of the internal conductor contact elements of a common internal conductor contact element pair, may also be understood to be an "asymmetry" within the scope of the invention.

A particular advantage of the invention is that an existing asymmetry in the electrical plug-in connector can advantageously be compensated for.

As a result, for example, asymmetrical internal conductor contact elements which can be produced in a cost-effective manner can be used for differential signal transmission, even though the asymmetry generally excludes the suitability of such internal conductor contact elements for radiofrequency technology. Therefore, a differential electrical plug-in connector can advantageously be fitted with cost-effective standard internal conductor contact elements which are easy to produce.

The compensation geometry can be determined by taking into account two hypothetical single-ended or asymmetrical transmission systems which are formed on the basis of the internal conductor contact element pair.

A differential transmission system, that is to say for example the electrical plug-in connector for transmitting a differential signal, in which two internal conductor contact elements are fed by a differential signal, can be broken down into two single-ended transmission systems. In such a hypothetical, single-ended transmission system, only one single internal conductor contact element is fed by the radiofrequency signal, while the other internal conductor contact element has a floating potential or is not connected to a fixed potential, while the external conductor contact element serves as a reference line.

In an advantageous development of the invention, it can be provided that the compensation geometry is designed to match the impedance of a first (hypothetical) asymmetrical transmission system and of a second (hypothetical) asymmetrical transmission system to one another. The first asymmetrical transmission system can comprise exclusively the first internal conductor contact element for signal conduction and the external conductor contact element for reference conduction. The second asymmetrical transmission system can comprise exclusively the second internal conductor contact element for signal conduction and the external conductor contact element for reference conduction.

Taking into account the asymmetrical transmission systems, a suitable compensation geometry can advantageously be established or verified by calculations and/or simulations.

According to a development of the invention, it can be provided that the compensation geometry extends parallel to the longitudinal axis.

It can also be provided that the compensation geometry extends completely or only along a sub-region of the asymmetry to be compensated for along the longitudinal axis. As an alternative or in addition, it can also be provided that the compensation geometry is spaced apart along the longitudinal axis from the asymmetry to be compensated for.

According to a development of the invention, it can be provided in particular that the axial region along the longitudinal axis, along which axial region the compensation geometry extends, is shorter than, is of the same length as or is longer than the axial region along the longitudinal axis, along which axial region the asymmetry extends. The axial region along which the compensation geometry extends can completely or partially overlap or not overlap the axial region along which the asymmetry extends.

The compensation geometry can preferably extend over the entire axial distance parallel to the asymmetry to be compensated for of the external conductor contact element, of the dielectric and/or of the internal conductor contact element pair.

However, the compensation geometry can also extend only along an axial section parallel to the asymmetry to be compensated for.

According to a development of the invention, it can be provided that the compensation geometry is designed as a material recess and/or as a material addition and/or as a material deformation and/or as a composite of different materials, in particular materials with different permittivities.

The compensation geometry is particularly preferably designed as a material recess. The material recess can be formed, for example, by holes, windows or other ablations in the external conductor contact element and/or in the dielectric.

A material deformation can also be advantageously suitable for forming the compensation geometry. For example, a curvature or a cross section-widening material deformation of the external conductor contact element instead of or in addition to a material recess can be highly suitable for forming a compensation geometry. A cross section-narrowing material deformation, for example of the external conductor contact element, can also be provided for forming the compensation geometry.

A compensation geometry as a composite of different materials can in particular be highly suitable for compensation of the asymmetry by the dielectric. For example, sections of the dielectric can be formed from different dielectric materials with different permittivities.

In a development of the invention, it can be provided that the dielectric is formed from at least one solid body.

The dielectric is preferably formed from at least one solid body, for example from a plastic. However, the dielectric may also be a gas, for example air.

It can also be provided that the electrical plug-in connector does not comprise a dielectric.

In a development of the invention, it can be provided that the first internal conductor contact element and the second internal conductor contact element have an identical, symmetrical cross-sectional geometry. The internal conductor contact elements are then preferably arranged asymmetrically within the external conductor contact element and/or within the dielectric, and this can lead to an asymmetry to be compensated for.

The internal conductor contact elements can be designed, for example, to be completely round.

Even if the internal conductor contact elements are each of completely symmetric design, they can nevertheless be arranged asymmetrically within the external conductor contact element and/or within the dielectric. The resulting non-uniform spacing of the internal conductor contact elements from an inner surface of the external conductor contact element can ultimately be compensated for according to the invention.

In an advantageous development of the invention, it can be provided that the first internal conductor contact element and the second internal conductor contact element have an identical, asymmetrical cross-sectional geometry.

The two internal conductor contact elements are preferably of identical, but asymmetrical, design. In order to save costs, two identical internal conductor contact elements, which in this combination would not be suitable for differential signal transmission in principle, can be used for the electrical plug-in connector as a result. However, on account of the compensation according to the invention of the asymmetry by the compensation geometry, an internal conductor contact element pair which is formed from two identical, asymmetrical internal conductor contact elements can nevertheless be used for differential signal transmission.

Particularly advantageously, the invention can be suitable for example for using internal conductor contact elements in accordance with the MQS standard ("Micro Quadlok System"). Internal conductor contact elements of this kind have an asymmetrical cross-sectional profile.

In a development of the invention, it can be provided that the first internal conductor contact element is arranged closer to an adjoining inner surface of the external conductor contact element than the second internal conductor contact element. It can then be provided that the compensation geometry runs in the external conductor contact element along the inner surface of the external conductor contact element, which inner surface adjoins the first internal conductor contact element, wherein the compensation geometry is preferably designed as a material recess and/or as a cross section-widening material deformation.

If the first internal conductor contact element is at a smaller distance from the external conductor contact element than the second internal conductor contact element, the impedance of the first (hypothetical) asymmetrical transmission system is more capacitive than the impedance of the second (hypothetical) asymmetrical transmission system. This can result in a one-dimensional optimization problem for establishing the compensation geometry, in particular if both internal conductor contact elements have an identical and symmetrical cross section.

A capacitive asymmetry of the first asymmetrical transmission system can be compensated for by an inductively acting countermeasure or by an inductively acting compensation geometry. To this end, for example, a material recess can be formed in the external conductor contact element in the region of the first internal conductor contact element. As an alternative or in addition, for example, a cross section-widening material deformation or convexity/curvature can also be provided in the external conductor contact element in the region of the first internal conductor contact element.

It can also be provided that the compensation geometry runs in the dielectric between the first internal conductor contact element and the adjoining inner surface of the external conductor contact element if the first internal conductor contact element is arranged closer to an adjoining inner surface of the external conductor contact element than the second internal conductor contact element. The compensation geometry can then be designed in particular as a material recess in the dielectric.

Therefore, provision can also be made to implement an inductively acting compensation geometry by forming material recesses, for example holes, in the dielectric, in particular in the region of the first internal conductor contact element which is arranged closer to the inner surface of the external conductor contact element. Since the permittivity of air is lower than the permittivity of a dielectric solid body, for example of a plastic which forms the dielectric, the effective permittivity of the dielectric in the region of the first internal conductor contact element can ultimately be reduced.

It should be noted at this point that the above references to a particular internal conductor contact element are intended to be understood in a merely exemplary manner. It can of course also be provided that the second internal conductor contact element is arranged closer to the inner surface of the external conductor contact element than the first internal conductor contact element. Where the embodiments above and below refer particularly to one of the internal conductor contact elements, this is in principle only for the purpose of simpler explanation and is not intended to be understood as being limiting. Provided that this is not technically excluded, the internal conductor contact elements can be exchanged as desired in the description above and below.

In an advantageous development of the invention, it can be provided that the second internal conductor contact element runs further away from an adjoining inner surface of the external conductor contact element than the first internal conductor contact element. It can then be provided that the compensation geometry runs in the external conductor contact element along the inner surface of the external conductor contact element, which inner surface adjoins the second internal conductor contact element, wherein the compensation geometry is preferably designed as a material addition and/or as a cross section-narrowing material deformation.

A cross section-narrowing material deformation is understood to mean that the cross section of the external conductor contact element is reduced in the direction of the longitudinal axis. The external conductor contact element can therefore curve inward, in the direction of the longitudinal axis.

Therefore, overall, a symmetry of the electrical plug-in connector can also be achieved by a capacitively acting countermeasure or compensation geometry. To this end, for example the distance between the second internal conductor contact element and the adjoining inner surface of the external conductor contact element can be reduced, preferably by said cross section-narrowing material deformation or a material addition within the external conductor contact element.

As an alternative or in addition, a capacitively acting compensation geometry can also be implemented in the dielectric by way of the compensation geometry being formed in the dielectric by using various materials with different permittivities. In particular, the permittivity in the dielectric adjoining the second internal conductor contact element can be increased.

In an advantageous development of the invention, it can be provided that the compensation geometry is designed to reduce the distance between the internal conductor contact elements of the internal conductor contact element pair.

A reduction in the distance between the two internal conductor contact elements of a common internal conductor contact element pair can be suitable in particular for compensating for a complex asymmetry of the electrical plug-in connector.

On account of the distance between the internal conductor contact elements being reduced, the field lines between the two internal conductor contact elements are concentrated more intensely and therefore the emission in the direction of the external conductor contact element is reduced. As a result, the influence of the asymmetry of the internal conductor contact elements is attenuated. The differential impedance can therefore be more stable since the influence of the external conductor contact element decreases.

A reduction in the distance between the two internal conductor contact elements can be advantageous for example if the two internal conductor contact elements have the same rectangular cross section and are rotated through 90° or through some other angle in relation to one another. However, a reduction in the distance between the two internal conductor contact elements can also be suitable if the two internal conductor contact elements each have the same asymmetrical cross section and are not rotated in relation to one another.

In an advantageous development of the invention, it can be provided that a shielding element which is electrically connected to the external conductor contact element extends along the longitudinal axis between at least two internal conductor contact element pairs.

An improvement to the compensation according to the invention of an asymmetry can be achieved by using an additional shielding element. The shielding element may be, for example, one or more metal pins and/or mandrels, in particular in the center of the plug-in connector.

In a development of the invention, it can be provided that precisely one internal conductor contact element pair, two or more internal conductor contact element pairs, three or more internal conductor contact element pairs or four or even more internal conductor contact element pairs are provided.

Any desired number of internal conductor contact element pairs can be provided in principle.

The plug-in connector according to the invention can particularly advantageously be used within a vehicle, in particular within a motor vehicle. Possible fields of use are autonomous driving, driver assistance systems, navigation systems, "infotainment" systems, rear seat entertainment systems, internet connections and wireless gigabit (IEEE 802.11ad standard). Possible applications relate to high-resolution cameras, for example 4K and 8K cameras, sensor systems, on-board computers, high-resolution screens, high-resolution dashboards, 3D navigation devices and mobile radio devices.

The plug-in connector according to the invention is suitable for any desired applications within electrical engineering as a whole and is not intended to be understood as limited to use in vehicle engineering.

The electrical plug-in connector is not limited to a specific type of plug-in connector, with the invention being suitable in particular for plug-in connectors for radiofrequency technology. The compensation according to the invention of the asymmetry can be transferred in particular to all types of differential plug-in connector. The invention can advantageously be suitable for example—but not exclusively—for AMEC ("Automotive Modular Ethernet Connection"), MTD ("Modular Twisted-Pair Data"), H-MTD ("High Speed Modular Twisted-Pair-Data") or HSD ("High-Speed Data") plug-in connectors.

The invention also relates to a method for producing an electrical plug-in connector for differential signal transmission, wherein the electrical plug-in connector has an external conductor contact element, a dielectric and at least one internal conductor contact element pair for differential signal transmission. The dielectric extends along a longitudinal axis through the external conductor contact element. The internal conductor contact element pair comprises a first internal conductor contact element and a second internal conductor contact element which both extend along the longitudinal axis through the dielectric.

According to a first variant of the method, it is provided that a compensation geometry is determined for the external conductor contact element and/or for the dielectric in order to compensate for an asymmetry of the internal conductor contact element pair with respect to the longitudinal axis.

In order to achieve a good symmetry (balance), for example internal conductor contact elements with an asymmetrical cross-sectional profile can be compensated for by a compensation geometry, which is selected in a defined manner, of the external conductor contact element and/or of the dielectric.

According to a second, optional or alternative variant of the method, it can also be provided that a compensation geometry is determined for the internal conductor contact element pair in order to compensate for an asymmetry of the external conductor contact element and/or of the dielectric with respect to the longitudinal axis.

The compensation geometry can prevent a transition of the differential signal transmission into the "common mode" taking place during the transmission of the electromagnetic wave. Therefore, an improved electromagnetic compatibility (EMC) and an improved signal-to-noise ratio (SNR) can be achieved by the compensation geometry.

Finally, differential signal transmission, in particular for radiofrequency technology, can advantageously be ensured despite the use of asymmetrical structures. As a result, the design and, respectively, the production of the electrical plug-in connector can be simplified and therefore can be more cost-effective.

According to a development of the method, it can be provided that the compensation geometry is determined by way of the impedance of a first (hypothetical) asymmetrical transmission system being matched to the impedance of a second (hypothetical) asymmetrical transmission system. For the first asymmetrical transmission system exclusively the first internal conductor contact element can be defined for signal conduction and the external conductor contact element can be defined for reference conduction. For the second asymmetrical transmission system exclusively the second internal conductor contact element can be defined for signal conduction and the external conductor contact element can be defined for reference conduction.

In an advantageous refinement of the method, it can be provided that the compensation geometry is established by iterative simulations in order to minimize a DC component during the differential signal transmission.

Iterative simulations can be highly suitable in particular in the case of plug-in connectors with complex geometries.

If, for example, a two-dimensional optimization problem arises for determining the compensation geometry, in addition to the distance between an internal conductor contact element and the adjoining inner surface of the external conductor contact element, the size of the surface or the angular segment of the internal conductor contact element in relation to the external conductor contact element can also be taken into account.

By way of approximation, the determination equation for the capacitance of a plate-type capacitor can be used for optimizing or for determining the compensation geometry. For example, an internal conductor contact element with a relatively large surface or angular region and with a relatively small distance from the respectively adjoining inner surface of the external conductor contact element has a higher capacitive impedance of the associated (hypothetical) asymmetrical transmission system.

A capacitively acting geometry of the first asymmetrical transmission system can be compensated for by an inductively acting compensation geometry of the first asymmetrical transmission system. A correspondingly inductively acting compensation geometry can be implemented for example by forming a material recess in the external conductor contact element. As an alternative or in addition, an inductively acting compensation geometry can be implemented by holes in the dielectric.

As an alternative, or in addition, a capacitively acting geometry of the first asymmetrical transmission system can be compensated for by a capacitively acting compensation geometry in the second asymmetrical transmission system. A corresponding compensation geometry can be formed for example by reducing the distance between the second internal conductor contact element and the inner surface of the external conductor contact element, which inner surface is adjacent to the second internal conductor contact element, by a material narrowing or concavity of the external conductor contact element or a further material layer within the external conductor contact element. As an alternative or in addition, a capacitively acting countermeasure can be formed in the second asymmetrical transmission system by using sections of different permittivity in the dielectric.

Features which have already been described in conjunction with the electrical plug-in connector can of course also be advantageously implemented for the method—and vice versa. Furthermore, advantages which have already been mentioned in conjunction with the electrical plug-in connector can also be understood as relating to the method—and vice versa.

It should additionally be pointed out that terms such as "comprising", "having" or "with" do not exclude other features or steps. Furthermore, terms such as "a(n)" or "the" indicating steps or features in the singular do not exclude a plurality of features or steps—and vice versa.

However, in a puristic embodiment of the invention, provision can also be made for the features which are introduced in the invention by the terms "comprising", "having" or "with" to be exhaustively listed. Accordingly, one or more lists of features can be considered to be exhaustive within the scope of the invention, for example for each claim in each case. The invention can, for example, consist exclusively of the features cited in Claim 1.

It should be mentioned that designations such as "first" or "second" etc. are predominantly used for reasons of distinguishability between respective apparatus and method features and are not necessarily intended to indicate that features require one another or are related to one another.

It should further be noted that the values and parameters described in the present case include deviations or fluctuations of ±10% or less, preferably ±5% or less, further preferably ±1% or less, and very particularly preferably ±0.1% or less, in the respectively mentioned value or parameter, provided that these deviations are not ruled out in practice when implementing the invention. The indication of ranges by start and end values also comprises all those values and fractions which are included by the respectively mentioned range, in particular the start and end values and a respective average value.

SUMMARY

A principal aspect of the present invention is an Electrical plug-in connector for differential signal transmission, having an external conductor contact element, a dielectric and at least one internal conductor contact element pair for differential signal transmission, wherein the dielectric extends along a longitudinal axis through the external conductor contact element, and wherein the internal conductor contact element pair comprises a first internal conductor contact element and a second internal conductor contact element which extend along the longitudinal axis through the dielectric, characterized in that the external conductor contact element and/or the dielectric have a compensation geometry in order to compensate for an asymmetry of the internal conductor contact element pair with respect to the longitudinal axis; and/or the internal conductor contact element pair has a compensation geometry in order to compensate for an asymmetry of the external conductor contact element and/or of the dielectric with respect to the longitudinal axis A further aspect of the present invention is an electrical plug-in connector characterized in that the compensation geometry is designed to match the impedance of a first asymmetrical transmission system and of a second asymmetrical transmission system to one another, wherein for the first asymmetrical transmission system exclusively the first internal conductor contact element is provided for signal conduction and the external conductor contact element is provided for reference conduction, and wherein for the second asymmetrical transmission system exclusively the second internal conductor contact element is provided for signal conduction and the external conductor contact element is provided for reference conduction.

A further aspect of the present invention is an electrical plug-in connector characterized in that the compensation geometry extends parallel to the longitudinal axis.

A further aspect of the present invention is an electrical plug-in connector characterized in that the axial region along the longitudinal axis, along which axial region the compensation geometry extends, is shorter than, is of the same length as or is longer than the axial region along the longitudinal axis, along which axial region the asymmetry extends, and wherein the axial region along which the compensation geometry extends completely or partially overlaps or does not overlap the axial region along which the asymmetry extends.

A further aspect of the present invention is an electrical plug-in connector characterized in that the compensation geometry is designed as a material recess and/or as a material addition and/or as a material deformation and/or as a composite of different materials.

A further aspect of the present invention is an electrical plug-in connector characterized in that the dielectric is formed from at least one solid body.

A further aspect of the present invention is an electrical plug-in connector characterized in that the first internal conductor contact element and the second internal conductor contact element have an identical, symmetrical cross-sectional geometry, wherein the internal conductor contact elements are arranged asymmetrically within the external conductor contact element and/or within the dielectric.

A further aspect of the present invention is an electrical plug-in connector characterized in that the first internal conductor contact element and the second internal conductor contact element have an identical, asymmetrical cross-sectional geometry.

A further aspect of the present invention is an electrical plug-in connector characterized in that the first internal conductor contact element is arranged closer to an adjoining inner surface of the external conductor contact element than the second internal conductor contact element, wherein the compensation geometry runs in the external conductor contact element along the inner surface of the external conductor contact element, which inner surface adjoins the first internal conductor contact element, and is designed as a material recess and/or as a cross section-widening material deformation; and/or runs in the dielectric between the first internal conductor contact element and the adjoining inner surface of the external conductor contact element and is designed as a material recess.

A further aspect of the present invention is an electrical plug-in connector characterized in that the second internal conductor contact element runs further away from an adjoining inner surface of the external conductor contact element than the first internal conductor contact element, wherein the compensation geometry runs in the external conductor contact element along the inner surface of the external conductor contact element, which inner surface adjoins the second internal conductor contact element, and is designed as a material addition and/or as a cross section-narrowing material deformation.

A further aspect of the present invention is an electrical plug-in connector characterized in that the compensation geometry is designed to reduce the distance between the internal conductor contact elements of the internal conductor contact element pair.

A further aspect of the present invention is an electrical plug-in connector characterized in that a shielding element which is electrically connected to the external conductor contact element extends between at least two internal conductor contact element pairs along the longitudinal axis.

A further aspect of the present invention is an electrical plug-in connector characterized in that precisely one internal conductor contact element pair, two or more internal conductor contact element pairs, three or more internal conductor contact element pairs or four or even more internal conductor contact element pairs are provided.

A still further aspect of the present invention is a method for producing an electrical plug-in connector for differential signal transmission, wherein the electrical plug-in connector has an external conductor contact element, a dielectric and at least one internal conductor contact element pair for differential signal transmission, wherein the dielectric extends along a longitudinal axis through the external conductor contact element, and wherein the internal conductor contact element pair comprises a first internal conductor contact element and a second internal conductor contact element which extend along the longitudinal axis through the dielectric, characterized in that a compensation geometry is determined for the external conductor contact element and/or for the dielectric in order to compensate for an asymmetry of the internal conductor contact element pair with respect to the longitudinal axis; and/or a compensation geometry is determined for the internal conductor contact element pair in order to compensate for an asymmetry of the external conductor contact element and/or of the dielectric with respect to the longitudinal axis.

An even still further aspect of the present invention is a method for producing an electrical plug-in connector characterized in that the compensation geometry is determined by way of the impedance of a first asymmetrical transmission system being matched to the impedance of a second asymmetrical transmission system, wherein for the first asymmetrical transmission system exclusively the first internal conductor contact element is used for signal conduction and the external conductor contact element is used for reference conduction, and wherein for the second asymmetrical transmission system exclusively the second internal conductor contact element is used for signal conduction and the external conductor contact element is used for reference conduction.

These and other aspects of the present invention are disclosed in more detail herein.

BRIEF DESCRIPTIONS OF THE DRAWINGS

Exemplary embodiments of the invention will be described in more detail with reference to the accompanying drawings.

The figures each show preferred exemplary embodiments in which individual features of the present invention are illustrated in combination with one another.

Features of an exemplary embodiment can also be implemented separately from the other features of the same exemplary embodiment, and can accordingly be readily combined by a person skilled in the art with features of other exemplary embodiments in order to form further meaningful combinations and sub-combinations.

In the figures, functionally identical elements are provided with the same reference signs/numerals.

Figure 4:
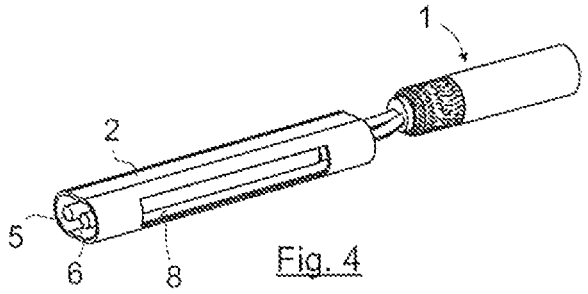
FIG. 4 is a top and side perspective illustration through an electric cable according to a first exemplary embodiment of the invention which is fitted with an external conductor contact element and an internal conductor contact element of an electrical plug-in connector.
Figure 5:
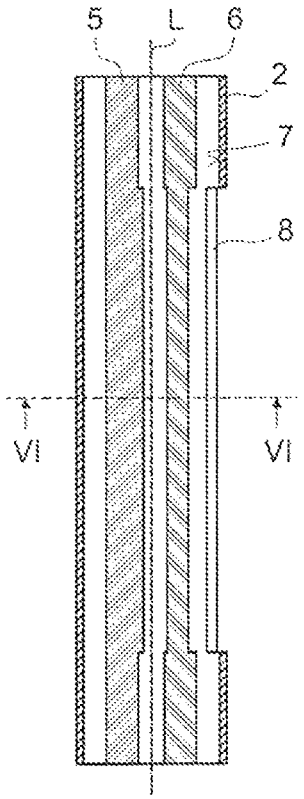

FIG. 5 schematically shows a sectional illustration through the plug-in connector components of FIG. 4 along the longitudinal axis.

Figure 6:
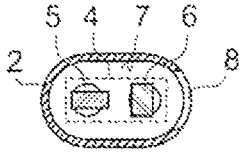

FIG. 6 schematically shows a cross section through the plug-in connector components of FIG. 4 taken along the sectional line VI-VI of FIG. 5.

Figure 7:
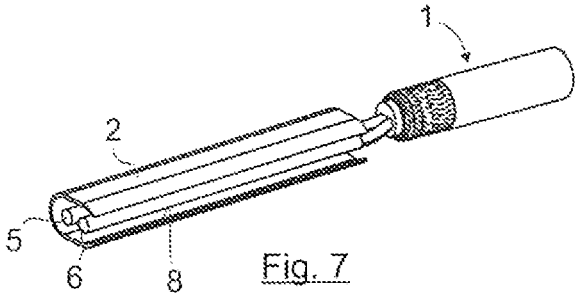

FIG. 7 is a top and side perspective illustration of an electric cable according to a second exemplary embodiment of the invention which is fitted with an external conductor contact element and an internal conductor contact element pair of an electrical plug-in connector.

Figure 8:
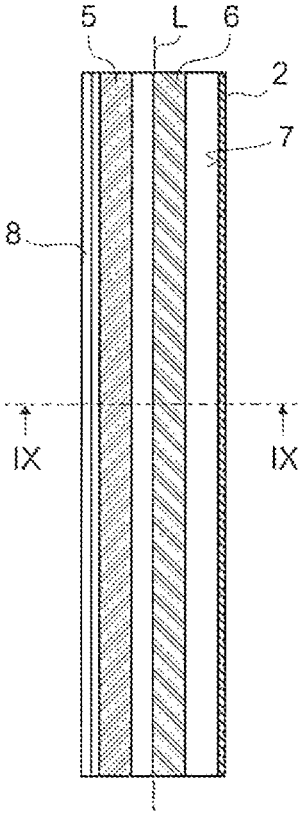

FIG. 8 schematically shows a sectional illustration through the plug-in connector components of FIG. 7 along the longitudinal axis.

Figure 9:
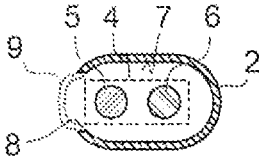

FIG. 9 schematically shows a cross section through the plug-in connector components of FIG. 7 taken along the sectional line IX-IX of FIG. 8.

Figure 10:
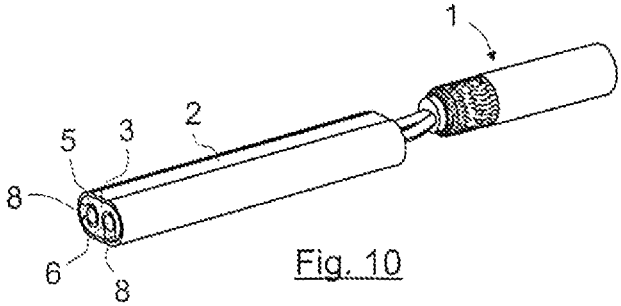

FIG. 10 is a top and side perspective illustration of an electric cable according to a third exemplary embodiment of the invention which is fitted with an external conductor contact element, a dielectric and an internal conductor contact element pair of an electrical plug-in connector.

Figure 11:
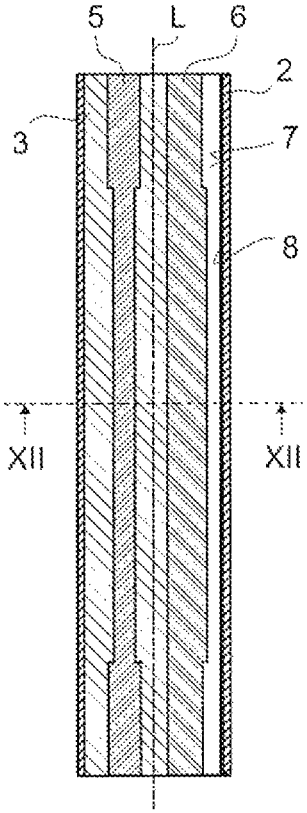

FIG. 11 schematically shows a sectional illustration of the plug-in connector components of FIG. 10 along the longitudinal axis.

Figure 12:
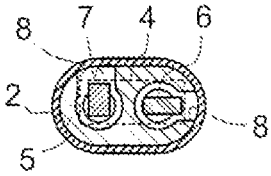

FIG. 12 schematically shows a cross section through the plug-in connector components of FIG. 10 taken along the sectional line XII-XII of FIG. 11.

Figure 13:
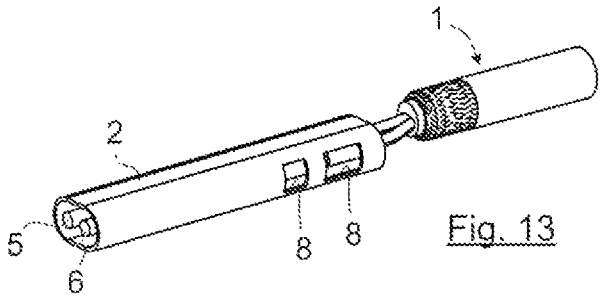

FIG. 13 is a top and side perspective illustration through an electric cable according to a fourth exemplary embodiment of the invention which is fitted with an external conductor contact element and an internal conductor contact element pair of an electrical plug-in connector.

Figure 14:
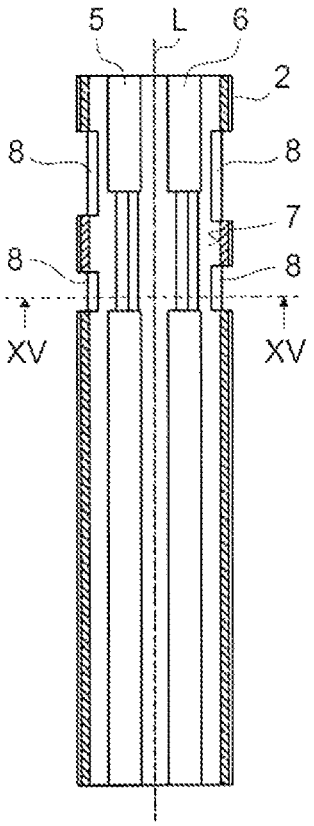

FIG. 14 schematically shows a sectional illustration through the plug-in connector components of FIG. 13 along the longitudinal axis.

Figure 15:
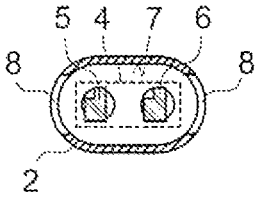

FIG. 15 schematically shows a cross section through the plug-in connector components of FIG. 13 taken along the sectional line XV-XV of FIG. 14.

Figure 16:
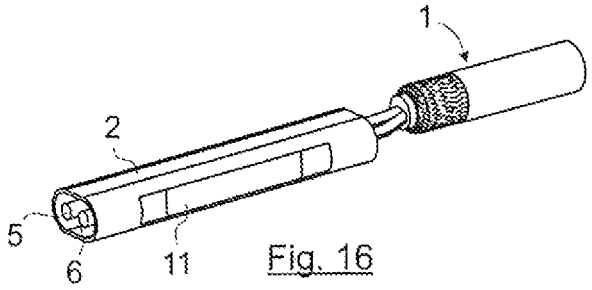

FIG. 16 is a top and side perspective illustration of an electric cable according to a fifth exemplary embodiment of the invention which is fitted with an external conductor contact element and an internal conductor contact element pair of an electrical plug-in connector.

Figure 17:
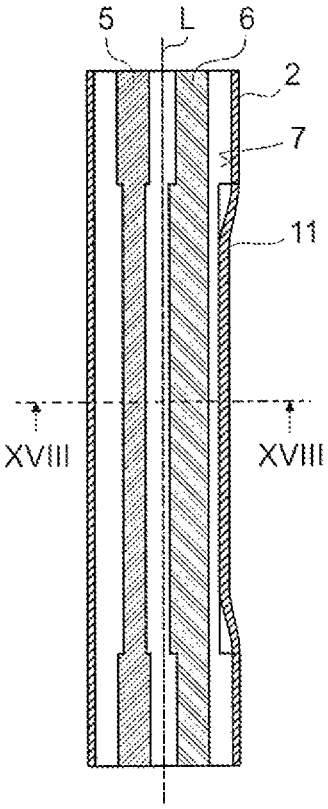

FIG. 17 schematically shows a sectional illustration through the plug-in connector components of FIG. 16 along the longitudinal axis.

Figure 18:
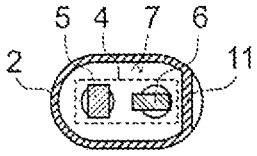

FIG. 18 schematically shows a cross section through the plug-in connector components of FIG. 16 taken along the sectional line XVIII-XVIII of FIG. 17.

Figure 19:
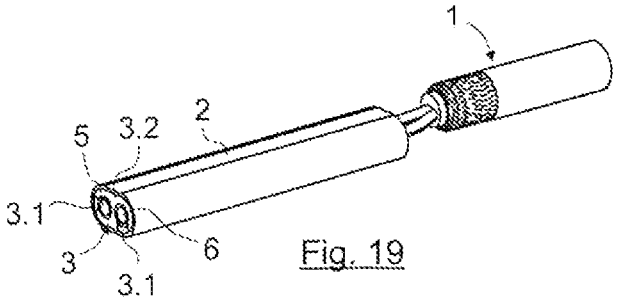

FIG. 19 is a top and side perspective illustration of an electric cable according to a sixth exemplary embodiment of the invention which is fitted with an external conductor contact element, a dielectric and an internal conductor contact element pair of an electrical plug-in connector.

Figure 20:
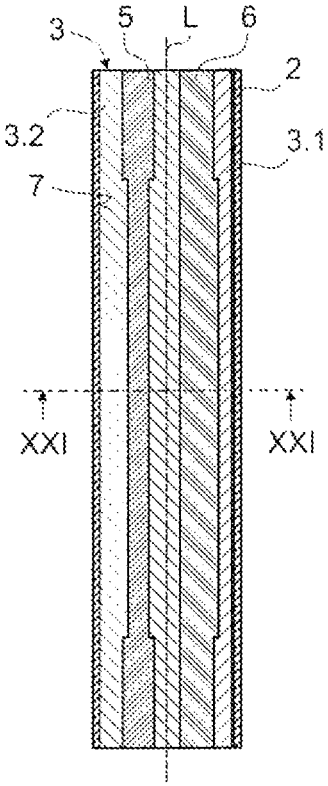

FIG. 20 schematically shows a sectional illustration through the plug-in connector components of FIG. 19 along the longitudinal axis.

Figure 21:
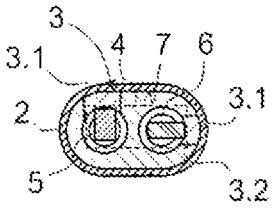

FIG. 21 schematically shows a cross section through the plug-in connector components of FIG. 19 taken along the sectional line XXI-XXI of FIG. 20.

Figure 22:
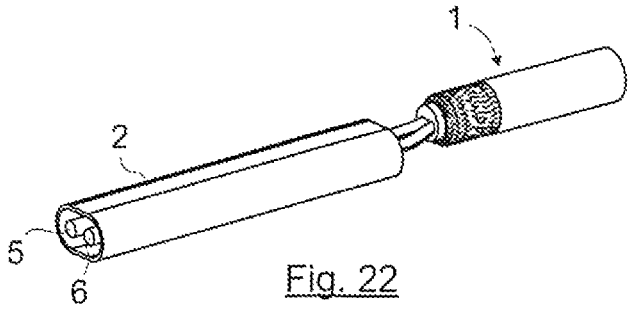

FIG. 22 is a top and side perspective illustration of an electric cable according to a seventh exemplary embodiment of the invention which is fitted with an external conductor contact element and an internal conductor contact element pair of an electrical plug-in connector.

Figure 23:
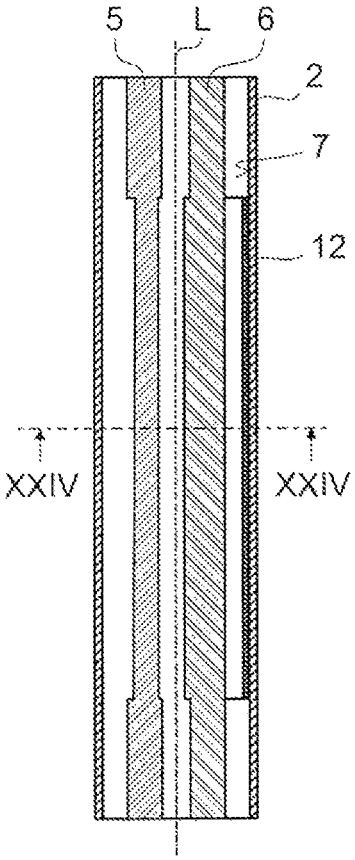

FIG. 23 schematically shows a sectional illustration through the plug-in connector components of FIG. 22 along the longitudinal axis.

Figure 24:
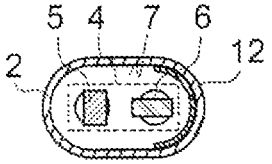

FIG. 24 schematically shows a cross section through the plug-in connector components of FIG. 22 taken along the sectional line XXIV-XXIV of FIG. 23.

Figure 25:
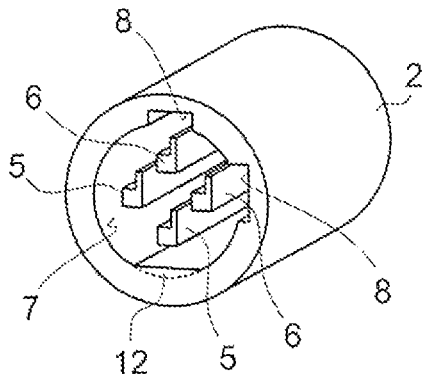

FIG. 25 schematically shows a perspective end illustration of an external conductor contact element and two internal conductor contact element pairs of an electrical plug-in connector.

Figure 26:
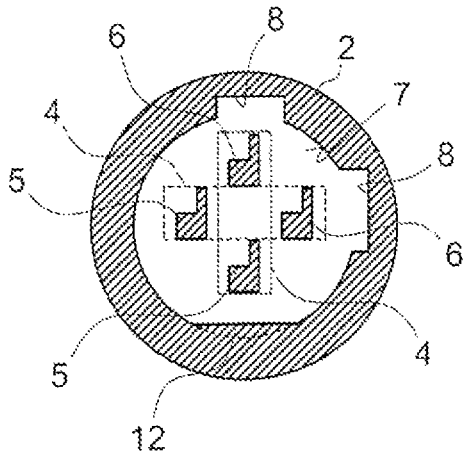

FIG. 26 schematically shows a cross section through the plug-in connector components of FIG. 25.

Figure 27:
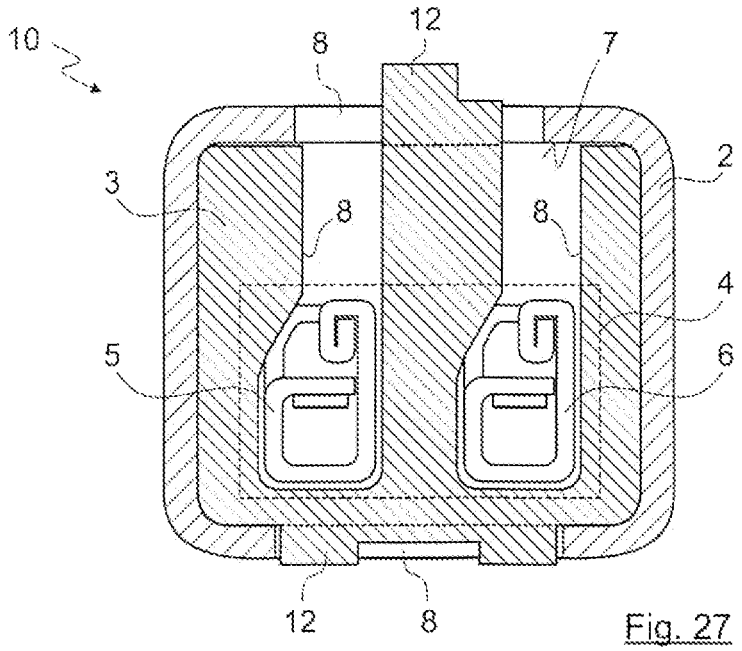

FIG. 27 schematically shows a cross section through an electrical plug-in connector comprising an external conductor contact element, a dielectric and an internal conductor contact element pair.

Figure 28:
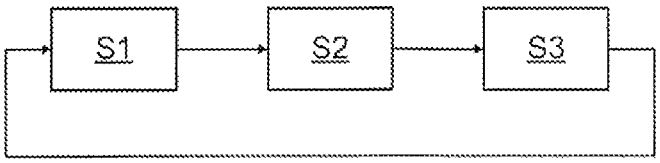

FIG. 28 is a block diagram that schematically shows a method for establishing a compensation geometry by iterative simulations.

DETAILED WRITTEN DESCRIPTION OF THE PREFERRED EMBODIMENTS

This disclosure of the invention is submitted in furtherance of the Constitutional purposes of the U.S. Patent laws "to promote the progress of science and useful arts (Article 1, Section 8).

Figure 1:
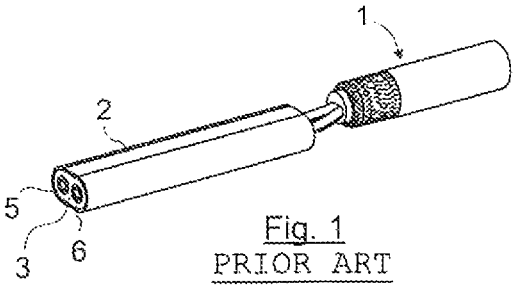
Fig. 1 PRIOR ART
FIG. 1 is a top and side perspective illustration of an electric cable according to the prior art which is fitted with an external conductor contact element, a dielectric and an internal conductor contact element pair of an electrical plug-in connector.
Figure 2:
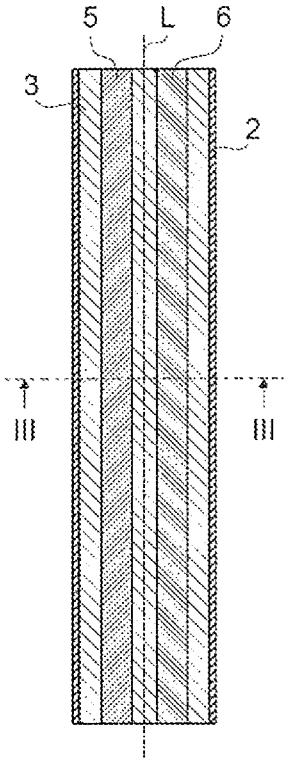
Fig. 2 PRIOR ART
FIG. 2 is an orthographic plan cross-section illustration through the plug-in connector components of FIG. 1 taken along the longitudinal axis.
Figure 3:
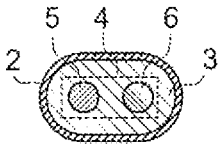
Fig. 3 PRIOR ART
FIG. 3 is an orthographic cross-section illustration through the plug-in connector components of FIG. 1 taken on line III-III of FIG. 2.

FIG. 1 shows a prefabricated electric cable 1 according to the prior art which is fitted with a plurality of plug-in connector components of an electrical plug-in connector. The cable 1 is fitted with an external conductor contact element 2, a dielectric 3 and an internal conductor contact element pair 4 (FIG. 3) for differential signal transmission. Said plug-in connector components 2, 3, 4 are part of a differential electrical plug-in connector, not illustrated in greater detail in FIGS. 1 to 3. FIG. 2 shows a longitudinal section view through the plug-in connector components 2, 3, 4, and FIG. 3 shows a cross section view through said components.

The dielectric 3 extends along a longitudinal axis L through the external conductor contact element 2. The internal conductor contact element pair 4 comprises a first internal conductor contact element 5 and a second internal conductor contact element 6 which both extend along the longitudinal axis L through the dielectric 3.

The plug-in connector components 2, 3, 4 are indicated merely highly schematically and by way of example in all of the figures. Where a following exemplary embodiment of the invention is described without a dielectric 3 (or at least without a dielectric 3 which is formed from a solid body), this is not to be understood as being limiting. In principle, a dielectric 3, or a dielectric 3 which is formed from a solid body, can be provided for each exemplary embodiment, or not.

According to the prior art, it is provided for differential signal transmission, in particular in radiofrequency technology, that the internal conductor contact elements 5, 6 of a common internal conductor contact element pair 4 are of symmetrical and identical design and are arranged in a uniformly distributed manner within the external conductor contact element 2 or the dielectric 3. This is intended to ensure that electrical signal transmission takes place entirely in the "differential mode".

According to the invention, it is provided that an asymmetry of a plug-in connector component 2, 3, 4 is compensated for by a suitable compensation geometry 8, 9, 11, 12 in the same or in another plug-in connector component 2, 3, 4.

Firstly, it can be provided that the external conductor contact element 2 and/or the dielectric 3 have/has a compensation geometry 8, 9, 11, 12 in order to compensate for an asymmetry of the internal conductor contact element pair 4 with respect to the longitudinal axis L. However, secondly, it can also be provided that the internal conductor contact element pair 4 has a compensation geometry 8, 9, 11, 12 in order to compensate for an asymmetry of the external conductor contact element 2 and/or of the dielectric 3 with respect to the longitudinal axis L.

FIGS. 4 to 27 show advantageous exemplary embodiments or exemplary compensation geometries 8, 9, 11, 12. The features of the exemplary embodiments illustrated can also be combined with one another. In particular, a large number of further compensation geometries for compensating any desired symmetries of any desired plug-in connector components 2, 3, 4 are also possible. The exemplary embodiments are intended to serve only to illustrate a few advantageous measures for producing the symmetry of an electrical plug-in connector using one or more compensation geometries according to the invention.

FIGS. 4 to 6 show a first exemplary embodiment of the invention. In the exemplary embodiment of FIGS. 4 to 6, there is no dielectric 3 or only a gaseous dielectric (generally air). However, a dielectric 3 comprising at least one solid body, as illustrated in FIGS. 1 to 3 or FIGS. 10 to 12 for example, can also be provided.

In the first exemplary embodiment, the internal conductor contact elements 5, 6 of the internal conductor contact element pair 4 are each of different and asymmetrical design and also rotated relative to one another. Owing to the asymmetrical cross-sectional geometry of the internal conductor contact elements 5, 6 and their relative rotation to one another, the second internal conductor contact element 6 of an adjoining inner surface 7 of the external conductor contact element 2 in the region of a central axial section along the longitudinal axis L provides a larger, more capacitively acting surface than the first internal conductor contact element 5. For compensation purposes, a compensation geometry is provided in the external conductor contact element 2 as a material recess 8. The external conductor contact element 2 has a corresponding window parallel to the longitudinal axis L and along the axial extent of the asymmetry of the internal conductor contact elements 5, 6.

In general, the impedances of a first (hypothetical) asymmetrical transmission system and of a second (hypothetical) asymmetrical transmission system can be matched to one another in order to determine the compensation geometry (geometries) 8, 9, 11, 12. In this case, the first asymmetrical transmission system can be defined as a transmission system in which exclusively the first internal conductor contact element 5 is used for signal conduction and the external conductor contact element 2 is used for reference conduction. The second asymmetrical transmission system can be defined as a transmission system in which exclusively the second internal conductor contact element 6 is used for signal conduction and the external conductor contact element 2 is used for reference conduction.

FIGS. 7 to 9 show a second exemplary embodiment of the invention. In this case, the first internal conductor contact element 5 and the second internal conductor contact element 6 have an identical, symmetrical cross-sectional geometry. However, the internal conductor contact element pair 4 of FIGS. 7 to 9 is offset in relation to the axis of symmetry of the external conductor contact element 2 within the external conductor contact element 2 in such a way that the first internal conductor contact element 5 is arranged closer to the inner surface 7 of the external conductor contact element 2 than the second internal conductor contact element 6. The first hypothetical asymmetrical transmission system is therefore more capacitive than the second hypothetical asymmetrical transmission system. According to the invention, the compensation geometry is determined in such a way that the impedances of the two transmission systems are matched to one another. To this end, the compensation geometry runs in the external conductor contact element 2 in a manner adjoining the first internal conductor contact element 5 and is, as in FIGS. 4 to 6, designed as a material recess 8.

As an alternative to the material recess 8, a cross section-widening material deformation 9 of the external conductor contact element 2 can also be provided for example (indicated in dashed lines in FIG. 9).

No dielectric 3, or no dielectric 3 which is formed from a solid body, is provided in the exemplary embodiment illustrated in FIGS. 7 to 9 either. If a dielectric 3 is provided, a compensation geometry can also be formed in the dielectric 3, wherein the dielectric 3 can have a material recess 8 for example between the first internal conductor contact element 5 and the inner surface 7 of the external conductor contact element 2.

FIGS. 10 to 12 illustrate a third exemplary embodiment of the invention. The internal conductor contact elements 5, 6 are, on the other hand, of different, asymmetrical design and rotated in relation to one another. A dielectric 3 which is formed from a solid body is also provided in the exemplary embodiment of FIGS. 10 to 12.

The compensation geometry is formed in the dielectric 3 by suitable material recesses 8 or by two longitudinal slots/grooves. A compensation geometry in the external conductor contact element 2 can be dispensed with as a result. However, a compensation geometry can also additionally be provided in the external conductor contact element 2.

A fourth exemplary embodiment of the invention is illustrated in FIGS. 13 to 15. FIGS. 13 to 15 show an internal conductor contact element pair 4 in which the first internal conductor contact element 5 and the second internal conductor contact element 6 have an identical, but asymmetrical, cross-sectional geometry. This variant is particularly preferred for forming an electrical plug-in connector according to the invention (for example the plug-in connector 10 illustrated in FIG. 27 below).

In order to compensate for the asymmetry, the external conductor contact element 2 has different compensation geometries along the longitudinal axis L which are each designed as a material recess 8. As already mentioned, as an alternative or in addition to a material recess 8, a cross section-widening material deformation 9 can also be provided, as indicated in FIG. 9.

In this case, compensation of the asymmetry takes place by way of example by the four material recesses 8 in the external conductor contact element 2 in the region of the asymmetry of the internal conductor contact elements 5, 6. The axial length of the material recesses 8 is different on both sides of the external conductor contact element 2 in this case.

FIGS. 16 to 18 show a fifth exemplary embodiment of the invention, wherein a configuration of the internal conductor contact elements 5, 6 which is comparable to the exemplary embodiment of FIGS. 4 to 6 is provided. It should be made clear with reference to the fifth exemplary embodiment that, instead of an inductively acting compensation geometry (for example a material recess 8) adjoining the more capacitively acting internal conductor contact element, a capacitively acting compensation geometry adjoining the more inductively acting internal conductor contact element (the second internal conductor contact element 6 in FIGS. 16 to 18) can also be provided. The corresponding compensation geometry can run in the external conductor contact element 2 along the inner surface 7 of the external conductor contact element 2, which inner surface adjoins the second internal conductor contact element 6, and can be designed as a cross section-narrowing material deformation 11.

FIGS. 19 to 21 show a sixth exemplary embodiment of the invention. It should be made clear with reference to FIGS. 19 to 21 that a compensation geometry can also be realized by a composite of different materials. To this end, the dielectric 3 is designed as a composite of two materials 3.1, 3.2, each with a different permittivity, in FIGS. 19 to 21.

A further exemplary embodiment of the invention is illustrated in FIGS. 22 to 24. It should be made clear with reference to FIGS. 22 to 24 that a compensation geometry for a configuration of an internal conductor contact element pair of the type as already illustrated in FIGS. 16 to 18 can also be realized by a material addition 12, that is to say for example a further metal layer within the external conductor contact element 2.

In addition to, or as an alternative to, the described variants of the invention, provision can also be made to reduce the distance between the internal conductor contact elements 5, 6 of the internal conductor contact element pair 4. As a result, concentration of the electromagnetic field lines can advantageously take place.

FIGS. 25 and 26 show an external conductor contact element 2 and two internal conductor contact element pairs 4 for a further electrical plug-in connector. The arrangement of the two internal conductor contact element pairs 4 corresponds to a so-called star quad. However, this arrangement is merely exemplary. A plug-in connector according to the invention can have, in principle, precisely one internal conductor contact element pair 4, as illustrated in FIGS. 1 to 24 and in FIG. 27. However, any desired number of internal conductor contact element pairs 4 can be provided in principle. For example, two, three, four or even more internal conductor contact element pairs 4 can be provided.

The internal conductor contact elements 5, 6 illustrated by way of example in FIGS. 25 and 26 are each of identical, but asymmetrical, design and arranged in a manner distributed around the longitudinal axis L or around the axis of symmetry of the external conductor contact element 2. The external conductor contact element 2 has a suitable compensation geometry (material recesses 8 and material addition 12) in order to ensure symmetrical operation overall.

A material addition 12 can also be designed in one piece in the external conductor contact element 2.

A shielding element which is galvanically connected to the external conductor contact element 2 can optionally run along the longitudinal axis L between the internal conductor contact element pairs 4 (not illustrated).

FIG. 27 shows a cross section through an electrical plug-in connector 10 comprising an external conductor contact element 2, a dielectric 3 and an internal conductor contact element pair 4 according to a preferred embodiment of the invention. However, in principle, the plug-in connector components 2, 3, 4 can also already be referred to in their own right as electrical plug-in connectors within the scope of the invention. By way of example, the electrical plug-in connector 10 of FIG. 27 has a single internal conductor contact element pair 4. However, as already stated, a plurality of internal conductor contact element pairs 4 can also be provided.

In the plug-in connector 10 illustrated in FIG. 27, the internal conductor contact elements 5, 6 of the common internal conductor contact element pair 4 are each of identical, but asymmetrical, design. The illustrated electrical plug-in connector 10 can advantageously be suitable for use in radiofrequency technology solely owing to the compensation geometry according to the invention.

The dielectric 3 and the external conductor contact element 2 have, by way of example, corresponding compensation geometries (material recesses 8 and material additions 12) in order to ensure symmetrical signal transmission through the electrical plug-in connector 10 overall.

In particular, if the electrical plug-in connector 10 or the external conductor contact element 2, the dielectric 3 and/or the internal conductor contact element pair 4 have a comparatively complex geometry, iterative simulations can be provided in order to minimize a DC component during the differential signal transmission and to establish a suitable compensation geometry 8, 9, 11, 12.

FIG. 28 shows an exemplary method sequence for an iterative simulation or for iteratively establishing a compensation geometry 8, 9, 11, 12.

In a first method step S1, the impedance of the first (hypothetical) asymmetrical transmission system can be determined, which transmission system uses the first internal conductor contact element 5 for signal transmission and the external conductor contact element 2 for reference transmission, while the second internal conductor contact element 6 is not allocated to a fixed potential and therefore has a floating potential.

In a second method step S2, the impedance of a second (hypothetical) asymmetrical transmission system can be ascertained, which transmission system uses the second internal conductor contact element 6 for signal conduction and the external conductor contact element 2 for reference conduction, while the first internal conductor contact element 5 is not allocated to a fixed potential and therefore has a floating potential.

In a third method step S3, a compensation geometry 8, 9, 11, 12 in the external conductor contact element 2, in the dielectric 3 and/or in the internal conductor contact element pair 4 can be determined and/or modified with the objective of matching the impedances of the two asymmetrical transmission systems to one another.

The method steps S1, S2, S3 can then be repeated or the impedances of the asymmetrical transmission systems can be determined once again and the compensation geometry (geometries) 8, 9, 11, 12 can optionally be further modified.

OPERATION

Having described the structure of my electrical plug-in connector for differential signal transmission, its operation is briefly described.

The present invention provides a method for producing an electrical plug-in connector 10 for differential signal transmission, and the method comprises the steps: providing an external conductor contact element 2 that defines a longitudinal axis L; providing a dielectric 3 that extends through the external conductor contact element 2 and along the longitudinal axis L; providing at least one internal conductor contact element pair 4 for differential signal transmission, and wherein the at least one internal conductor contact element pair 4 comprises a first internal conductor contact element 5 and a second internal conductor contact element 6 which both extend along the longitudinal axis L through the dielectric 3; and providing a compensation geometry 8, 9, 11, 12 for at least one of the external conductor contact element 2 and/or for the dielectric 3 to compensate for an asymmetry of the at least one internal conductor contact element pair 4 with respect to the longitudinal axis L; and/or providing a compensation geometry 8, 9, 11, 12 for the at least one internal conductor contact element pair 4 to compensate for an asymmetry of at least one of the external conductor contact element 2 and/or for the dielectric 3 with respect to the longitudinal axis L.

The method may further comprise the step wherein the compensation geometry 8, 9, 11, 12 is determined by matching an impedance of a first asymmetrical transmission system to an impedance of a second asymmetrical transmission system, and wherein for the first asymmetrical transmission system exclusively, the first internal conductor contact element 5 is used for signal conduction and the external conductor contact element 2 is used for reference conduction, and wherein for the second asymmetrical transmission system exclusively, the second internal conductor contact element 6 is used for signal conduction and the external conductor contact element 2 is used for reference conduction.

An electrical plug-in connector 10 for differential signal transmission having an external conductor contact element that defines a longitudinal axis; 2, a dielectric that extends through the external conductor contact element and along the longitudinal axis; 3 and at least one internal conductor contact element pair 4 for the differential signal transmission, and wherein the at least one internal conductor contact element pair 4 comprises a first internal conductor contact element 5 and a second internal conductor contact element 6 both which extend along the longitudinal axis L through the dielectric; and 3, at least one of the external conductor contact element 2 and the dielectric 3 has a compensation geometry 8, 9, 11, 12 to compensate for an asymmetry of the at least one internal conductor contact element pair 4 with respect to the longitudinal axis L; and the at least one internal conductor contact element pair 4 has a compensation geometry 8, 9, 11, 12 to compensate for an asymmetry of at least one of the external conductor contact element 2 or the dielectric 3 with respect to the longitudinal axis L.

An electrical plug-in connector 10 wherein the compensation geometry 8, 9, 11, 12 matches an impedance of a first asymmetrical transmission system and of a second asymmetrical transmission system to one another, and wherein for the first asymmetrical transmission system exclusively, the first internal conductor contact element 5 is provided for signal conduction and the external conductor contact element 2 is provided for reference conduction, and wherein for the second asymmetrical transmission system exclusively, the second internal conductor contact element 6 is provided for signal conduction and the external conductor contact element 2 is provided for reference conduction.

An electrical plug-in connector 10 wherein the compensation geometry 8, 9, 11, 12 extends parallel to the longitudinal axis L.

An electrical plug-in connector 10 wherein an axial region along the longitudinal axis L, and along which the compensation geometry 8, 9, 11, 12 extends, at least partially overlaps an axial region along which the asymmetry extends.

An electrical plug-in connector 10 wherein the compensation geometry 8, 9, 11, 12 is designed as at least one of a material recess 8, a material addition 12, a material deformation 9, 11 or a composite of different materials 3.1, 3.2.

An electrical plug-in connector 10 wherein the dielectric 3 is formed from at least one solid body.

An electrical plug-in connector 10 wherein the first internal conductor contact element 5 and the second internal conductor contact element 6 have an identical, symmetrical cross-sectional geometry, and wherein the first and second internal conductor contact elements 5, 6 are arranged asymmetrically within at least one of the external conductor contact element and the dielectric 3.

An electrical plug-in connector 10 wherein the first internal conductor contact element 5 and the second internal conductor contact element 6 have an identical, asymmetrical cross-sectional geometry.

An electrical plug-in connector 10 wherein the first internal conductor contact element 5 is arranged closer to an adjoining inner surface 7 of the external conductor contact element 2 than the second internal conductor contact element 6, and wherein the compensation geometry is along the inner surface of the external conductor contact element 2, and the inner surface of the external conductor contact element adjoins the first internal conductor contact element 5, and is at least one of a material recess 8 or a cross section-widening material deformation (9); and the compensation geometry is in the dielectric 3 between the first internal conductor contact element 5 and the adjoining inner surface 7 of the external conductor contact element 2 and is designed as a material recess 8.

An electrical plug-in connector 10 wherein the second internal conductor contact element 6 is further away from an adjoining inner surface 7 of the external conductor contact element 2 than the first internal conductor contact element 5, and wherein the compensation geometry is within the external conductor contact element 2 and extends along the along the inner surface 7 of the external conductor contact element 2, and the inner surface 7 of the external conductor contact element 2 adjoins the second internal conductor contact element 6, and the compensation geometry is at least one of a material addition 12, or a cross section-narrowing material deformation 11.

An electrical plug-in connector 10 wherein the compensation geometry 8, 9, 11, 12 reduces a distance between the first and second internal conductor contact elements 5, 6 of the at least one internal conductor contact element pair 4.

An electrical plug-in connector 10 having a shielding element which is electrically connected to the external conductor contact element; and the shielding element 2 extends between at least two internal conductor contact element pairs 4 along the longitudinal axis L.

An electrical plug-in connector 10 having plural internal conductor contact element pairs 4.

An electrical plug-in connector 10 for differential signal transmission having an external conductor contact element 2 that defines a longitudinal axis L; a dielectric 3 that extends through the external conductor contact element 2 and along the longitudinal axis L; and at least one internal conductor contact element pair 4 for the differential signal transmission, and wherein the at least one internal conductor contact element pair 4 comprises a first internal conductor contact element 5 and a second internal conductor contact element 6 both which extend along the longitudinal axis L through the dielectric 3; and at least one of the external conductor contact element 2 or the dielectric 3 has a compensation geometry 8, 9, 11, 12 to compensate for an asymmetry of the at least one internal conductor contact element pair 4 with respect to the longitudinal axis L; and/or the at least one internal conductor contact element pair 4 has a compensation geometry 8, 9, 11, 12 to compensate for an asymmetry of at least one of the external conductor contact element 2 and/or the dielectric 3 with respect to the longitudinal axis L.

An electrical plug-in connector 10 for differential signal transmission having an external conductor contact element 2 that defines a longitudinal axis L; a dielectric 3 that extends through the external conductor contact element 2 and along the longitudinal axis L; and at least one internal conductor contact element pair 4 for the differential signal transmission, and wherein the at least one internal conductor contact element pair 4 comprises a first internal conductor contact element 5 and a second internal conductor contact element 6 both which extend along the longitudinal axis L through the dielectric 3, and the at least one internal conductor contact element pair 4 has a compensation geometry 8, 9, 11, 12 to compensate for an asymmetry of at least one of the external conductor contact element 2 or the dielectric 3 with respect to the longitudinal axis L.

An electrical plug-in connector 10 wherein an axial region along the longitudinal axis L, and along which the compensation geometry 8, 9, 11, 12 extends, does not overlap an axial region along which the asymmetry extends.

An electrical plug-in connector 10 wherein the first internal conductor contact element 5 is arranged closer to an adjoining inner surface 7 of the external conductor contact element 2 than the second internal conductor contact element 6, and wherein the compensation geometry 8, 9, 11, 12 is in the dielectric 3 between the first internal conductor contact element 5 and the adjoining inner surface 7 of the external conductor contact element 2 and the compensation geometry 8, 9, 11, 12 is a material recess.

An electrical plug-in connector 10 for differential signal transmission, having an external conductor contact element 2, a dielectric 3 and at least one internal conductor contact element pair 4 for differential signal transmission, wherein the dielectric 3 extends along a longitudinal axis L through the external conductor contact element 2, and wherein the internal conductor contact element pair 4 comprises a first internal conductor contact element 5 and a second internal conductor contact element 6 which extend along the longitudinal axis L through the dielectric 3, characterized in that the external conductor contact element 2 and/or the dielectric 3 have a compensation geometry 8, 9, 11, 12 in order to compensate for an asymmetry of the internal conductor contact element pair 4 with respect to the longitudinal axis L; and/or the internal conductor contact element pair 4 has a compensation geometry 8, 9, 11, 12 in order to compensate for an asymmetry of the external conductor contact element 2 and/or of the dielectric 3 with respect to the longitudinal axis L.

In compliance with the statute, the present invention has been described in language more or less specific as to the structural and methodical features. It is to be understood, however, that the invention is not limited to the specific features shown and described since the means herein disclosed comprise preferred forms of putting the invention into effect. The invention is therefore claimed, in any of its forms or modifications, within the proper scope of the appended claims appropriately interpreted in accordance with the doctrine of equivalents.

The invention claimed is:

1. An electrical plug-in connector for differential signal transmission, comprising:

an external conductor contact element that defines a longitudinal axis;

a dielectric that extends through the external conductor contact element and along the longitudinal axis; and at least one internal conductor contact element pair for the differential signal transmission, and wherein the at least one internal conductor contact element pair comprises a first internal conductor contact element and a second internal conductor contact element both which extend along the longitudinal axis through the dielectric; and at least one of the external conductor contact element or the dielectric has a compensation geometry to compensate for an asymmetry of the at least one internal conductor contact element pair with respect to the longitudinal axis.

2. The electrical plug-in connector as claimed in claim 1 and wherein the compensation geometry matches an impedance of a first asymmetrical transmission system and of a second asymmetrical transmission system to one another, and wherein for the first asymmetrical transmission system exclusively, the first internal conductor contact element is provided for signal conduction and the external conductor contact element is provided for reference conduction, and wherein for the second asymmetrical transmission system exclusively, the second internal conductor contact element is provided for signal conduction and the external conductor contact element is provided for reference conduction.

3. The electrical plug-in connector as claimed in claim 1 and wherein the compensation geometry extends parallel to the longitudinal axis.

4. The electrical plug-in connector as claimed in claim 1 and wherein an axial region along the longitudinal axis, and along which the compensation geometry extends, at least partially overlaps an axial region along which the asymmetry extends.

5. The electrical plug-in connector as claimed in claim 1 and wherein the compensation geometry is designed as at least one of a material recess, a material addition, a material deformation, or a composite of different materials.

6. The electrical plug-in connector as claimed in claim 1 and wherein the dielectric is formed from at least one solid body.

7. The electrical plug-in connector as claimed in claim 1 and wherein the first internal conductor contact element and the second internal conductor contact element have an identical, symmetrical cross-sectional geometry, and wherein the first and second internal conductor contact elements are arranged asymmetrically within at least one of the external conductor contact element and the dielectric.

8. The electrical plug-in connector as claimed in claim 1 and wherein the first internal conductor contact element and the second internal conductor contact element have an identical, asymmetrical cross-sectional geometry.

9. The electrical plug-in connector as claimed in claim 1 and wherein the first internal conductor contact element is arranged closer to an adjoining inner surface of the external conductor contact element than the second internal conductor contact element, and wherein the compensation geometry is along the inner surface of the external conductor contact element, and the inner surface of the external conductor contact element adjoins the first internal conductor contact element, and is at least one of a material recess or a cross section-widening material deformation; and the compensation geometry is in the dielectric between the first internal conductor contact element and the adjoining inner surface of the external conductor contact element and is designed as a material recess.

10. The electrical plug-in connector as claimed in claim 1 and wherein the second internal conductor contact element is further away from an adjoining inner surface of the external conductor contact element than the first internal conductor contact element, and wherein the compensation geometry is within the external conductor contact element and extends along the inner surface of the external conductor contact element, and the inner surface of the external conductor contact element adjoins the second internal conductor contact element, and the compensation geometry is at least one of a material addition, or a cross section-narrowing material deformation.

11. The electrical plug-in connector as claimed in claim 1 and further comprising:

a shielding element which is electrically connected to the external conductor contact element; and the shielding element extends between at least two internal conductor contact element pairs along the longitudinal axis.

12. The electrical plug-in connector as claimed in claim 1 and further comprising:

plural internal conductor contact element pairs.

13. The electrical plug-in connector as claimed in claim 1 and wherein an axial region along the longitudinal axis, and along which the compensation geometry extends, does not overlap an axial region along which the asymmetry extends.

14. The electrical plug-in connector as claimed in claim 1 and wherein the first internal conductor contact element is arranged closer to an adjoining inner surface of the external conductor contact element than the second internal conductor contact element, and wherein the compensation geometry is in the dielectric between the first internal conductor contact element and the adjoining inner surface of the external conductor contact element and the compensation geometry is a material recess.

15. A method for producing an electrical plug-in connector for differential signal transmission, comprising the steps:

providing an external conductor contact element that defines a longitudinal axis;

providing a dielectric that extends through the external conductor contact element and along the longitudinal axis;

providing at least one internal conductor contact element pair for differential signal transmission, and wherein the at least one internal conductor contact element pair comprises a first internal conductor contact element and a second internal conductor contact element which both extend along the longitudinal axis through the dielectric; and providing a compensation geometry for at least one of the external conductor contact element or the dielectric to compensate for an asymmetry of the at least one internal conductor contact element pair with respect to the longitudinal axis.

16. The method as claimed in claim 15 and wherein the compensation geometry is determined by matching an impedance of a first asymmetrical transmission system to an impedance of a second asymmetrical transmission system, and wherein for the first asymmetrical transmission system exclusively, the first internal conductor contact element is used for signal conduction and the external conductor contact element is used for reference conduction, and wherein for the second asymmetrical transmission system exclusively, the second internal conductor contact element is used for signal conduction and the external conductor contact element is used for reference conduction.

17. An electrical plug-in connector for differential signal transmission, comprising:

an external conductor contact element that defines a longitudinal axis;

a dielectric that extends through the external conductor contact element and along the longitudinal axis; and at least one internal conductor contact element pair for the differential signal transmission, and wherein the at least one internal conductor contact element pair comprises a first internal conductor contact element and a second internal conductor contact element both which extend along the longitudinal axis through the dielectric, and the at least one internal conductor contact element pair has a compensation geometry to compensate for an asymmetry of at least one of the external conductor contact element or the dielectric with respect to the longitudinal axis.

18. The electrical plug-in connector as claimed in claim 17 and wherein the compensation geometry reduces a distance between the first and second internal conductor contact elements of the at least one internal conductor contact element pair.

19. A method for producing an electrical plug-in connector for differential signal transmission, comprising the steps:

providing an external conductor contact element that defines a longitudinal axis;

providing a dielectric that extends through the external conductor contact element and along the longitudinal axis;

providing at least one internal conductor contact element pair for differential signal transmission, and wherein the at least one internal conductor contact element pair comprises a first internal conductor contact element and a second internal conductor contact element which both extend along the longitudinal axis through the dielectric;

providing a compensation geometry for the at least one internal conductor contact element pair to compensate for an asymmetry of at least one of the external conductor contact element or the dielectric with respect to the longitudinal axis.

20. The method as claimed in claim 19 and wherein the compensation geometry is determined by matching an impedance of a first asymmetrical transmission system to an impedance of a second asymmetrical transmission system, and wherein for the first asymmetrical transmission system exclusively, the first internal conductor contact element is used for signal conduction and the external conductor contact element is used for reference conduction, and wherein for the second asymmetrical transmission system exclusively, the second internal conductor contact element is used for signal conduction and the external conductor contact element is used for reference conduction.

* * * * *